United States Patent [19]

Compeau et al.

[11] Patent Number: 4,875,723

[45] Date of Patent: Oct. 24, 1989

[54] CLOSURE LATCH

[75] Inventors: David E. Compeau, Mt. Clemens; Mark Manuel, Sterling Heights; Lloyd W. Rogers, Jr., Utica, all of Mich.

[73] Assignee: General Motors Corporation, Detroit, Mich.

[21] Appl. No.: 163,503

[22] Filed: Mar. 3, 1988

[51] Int. Cl.[4] ..... E05C 3/26

[52] U.S. Cl. ..... 292/201; 292/DIG. 61; 292/DIG. 62

[58] Field of Search ..... 292/144, 199, 201, 216, 292/280, DIG. 61, DIG. 62

[56] References Cited

U.S. PATENT DOCUMENTS

| | | | |
|---|---|---|---|
| 2,731,821 | 1/1956 | Lloyd | 70/100 |
| 4,653,784 | 3/1987 | Lee | 292/71 |
| 4,763,936 | 8/1988 | Rogakos et al. | 292/201 |
| 4,776,619 | 10/1988 | Daugherty et al. | 292/201 |

*Primary Examiner*—Richard E. Moore
*Attorney, Agent, or Firm*—Herbert Furman

[57] ABSTRACT

An actuating means for a vehicle body closure latch includes a driver or passenger controlled electric motor driving a reciprocable rack through a gear train. The rack is resiliently biased to a neutral position and shifts an actuator from neutral to an operating position when the rack is moved from the neutral position to a driving position. The actuator is engageable with a latch operator to control movement of the latch bolt to unlatched position when the actuator moves to an operating position. When the actuator reaches the operating position, the actuator is positively stopped to stall the motor or power operator. When the power is removed from the stalled motor or power operator by the driver or passenger releasing a switch, the bias of the resilient centering means returns the rack to its initial neutral or starting position and back drives the motor through the gear train.

11 Claims, 4 Drawing Sheets

CLOSURE LATCH

This invention relates generally to vehicle body closure latches and more particularly to an improved actuating means controlling movement of a latch bolt to unlatched position.

The subject matter of this application is related to that of copending applications Ser. No. 895,195, Garwood et al, Vehicle Door Latch, filed Aug. 11, 1986; Ser. No. 162,990, Hoffman et al, Electrical Switch for Door Latch, filed Mar. 2, 1988, now U.S. Pat. No. 4,806,712, filed Feb. 21, 1989; and Ser. No. 164,903, Haag et al, Electronic Vehicle Door Lock/Unlatch Control, filed Mar. 7, 1988, all of which are assigned to the assignee of this invention.

The closure latch of this invention includes a latch bolt which is movable between latched and unlatched positions, and a detent movable between detented and undetented positions with respect to the latch bolt. The detent is resiliently biased to detented position wherein it maintains the latch bolt in the latched position against the bias of resilient means which biases the latch bolt to unlatched position. The actuating means of this invention controls the movement of the detent between detented and undetented positions. The actuating means can (1) directly control the detent; or, (2) control other levers of the closure latch, such as an operating lever, which in turn controls the detent; or (3) control the locking means of the latch, such as the locking lever which places the latch in locked or unlocked condition.

In the preferred embodiment of the invention, the actuating means includes a reciprocable rack driven by a driver or passenger controlled motor or power operator through a gear train. The rack is guided for linear movement relative to the latch frame and is normally located in a neutral position by resilient centering means. When the rack is driven by the power operator and gear train to a driving position, it concurrently drives an actuator from a neutral position to an operating position wherein the actuator (1) is directly coupled to move the detent to undetented position; or (2) is indirectly coupled to the detent through an operating lever which moves the detent to undetented position; or, (3) moves the locking lever of the latch to locked or unlocked position.

When the actuator reaches the operating position, the actuator is positively stopped to stall the motor or power operator. When the power is removed from the stalled motor or power operator by the driver or passenger releasing a switch, the bias of the resilient centering means returns the rack to its initial neutral or starting position and back drives the motor through the gear train.

The primary feature of this invention is to provide an improved actuating means for releasing a detent from detented engagement with a latch bolt to permit movement of the latch bolt from a latched position to an unlatched position. Another feature is that the actuating means includes an actuator which is power driven between neutral and operating positions and is (1) directly coupled to the detent to move the detent to undetented position; or (2) is indirectly coupled to the detent through intervening levers; or (3) is coupled to the locking means of the latch. A further feature is that the actuator is driven by the power operator through an intervening rack which is normally resiliently centered in a neutral position and is moved to a driving position against the bias of the resilient centering means. Yet another feature is that the actuator moves to the operating position concurrently with movement of the rack to driving position. Yet another feature is that the actuator is positively stopped in the operating position to stall the power operator as the detent moves to undetented position. Still another feature is that the resilient centering means returns the rack to its neutral position and back drives the power operator when the power is removed from the power operator.

These and other features will be readily apparent from the following specification and drawings wherein.

Figure 2:
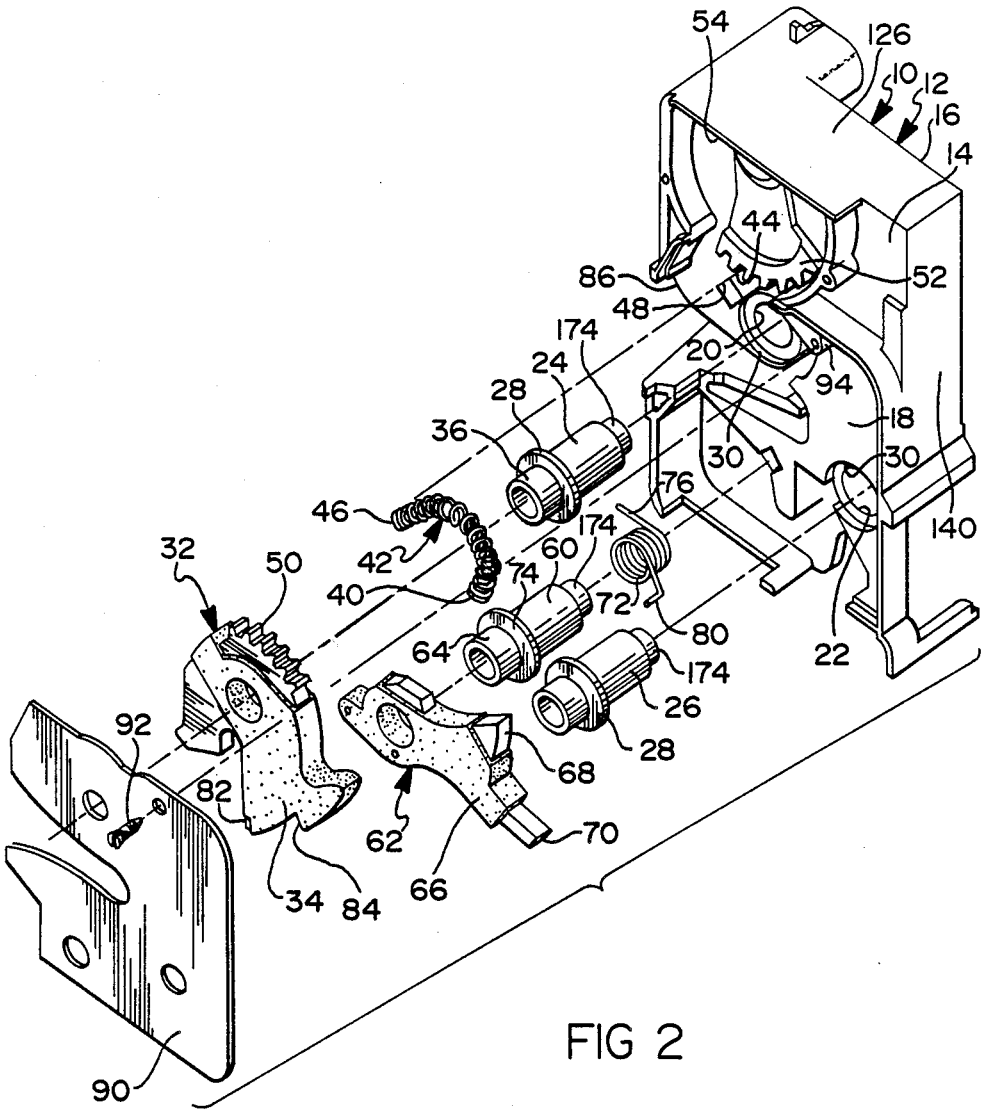
FIG. 2 is a blown apart perspective view of the closure latch showing the latch bolt and detent.
Figure 3:
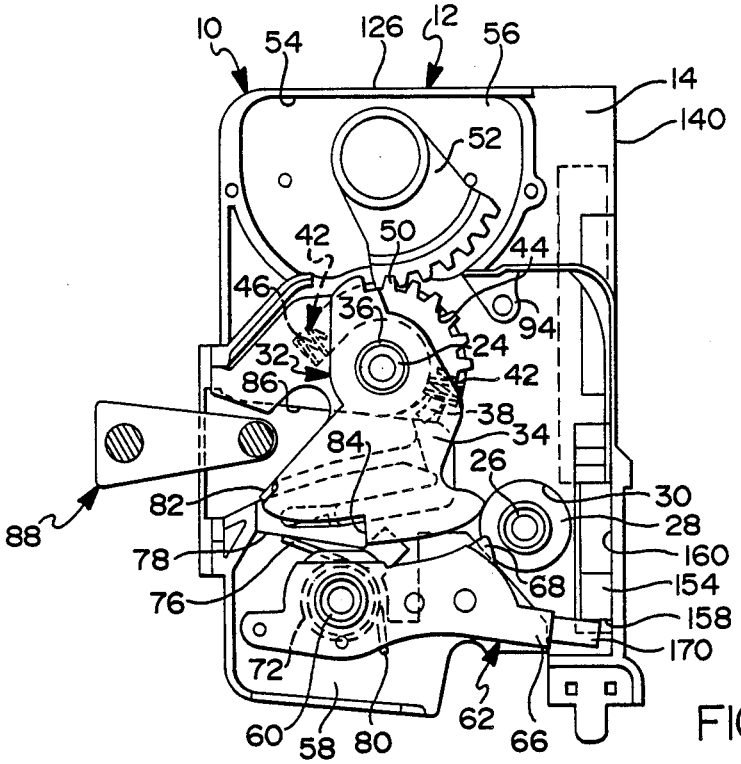
FIG. 3 is a view showing the latch bolt and detent in unlatched position.
Figure 4:
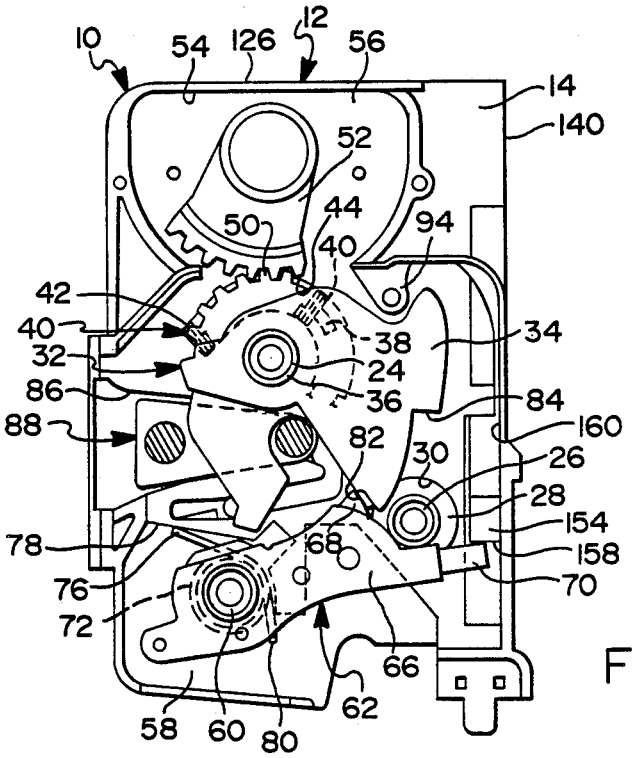
FIG. 4 is a view similar to FIG. 3 showing the latch bolt and detent in latched position.

Referring now particularly to FIGS. 2, 3, and 4 of the drawings, a closure latch designated generally 10 includes a latch frame 12 of molded plastic material. The latch frame 12 has one open side 14 thereof facing the latch pillar end wall of a vehicle door, not shown, on which the latch 10 is mounted, and the other open side 16 thereof facing the opposite or hinge pillar end wall of the door.

The side 14 of frame 12 includes a recessed wall 18 which is provided with through apertures 20 and 22 which respectively receive like hollow studs 24 and 26. Each of these studs includes a flange 28, with these flanges being received in recesses 30 which surround the apertures in wall 18. A latch bolt 32, which is partially plastic covered, as indicated at 34, is rotatably mounted on one end 36 of stud 24. The latch bolt includes an extending abutment 38, FIGS. 3 and 4, which engages one end 40, FIG. 2, of a coil compression spring 42. Spring 42 is housed in a recess 44 of wall 18. The other end 46, FIG. 2, of the spring engages an end wall 48 of the recess. Spring 42 biases the latch bolt 32 clockwise as viewed in FIGS. 3 and 4 from its full latched position shown in FIG. 4 to its unlatched position shown in FIG. 3.

The latch bolt 32 includes a partially toothed periphery 50 which meshes with a sector 52 rotatably mounted in a recess 54 of the latch frame 12. Mounted within the recess 54 underneath a cover 56 is a switch arrangement which is shown in detail in copending application Ser. No. 162,990. The circuitry is shown in Ser. No. 164,903. Since the details of the switch arrangement and circuitry are not necessary to an understanding of this invention, they are not disclosed herein.

The latch frame 12 includes a further recessed wall 58 which is though apertured to receive a stud 60 which is the same as the studs 24 and 26. An apertured detent 62 is rotatably mounted on the end 64 of stud 60. The detent is partially plastic coated as indicated at 66, FIG. 2, and includes a detent shoulder 68 which is not plastic coated and a detent extension or arm 70 which is likewise not plastic coated. A coil torsion spring 72 surrounds the stud 60 between the flange 74 of the stud and the wall 58. One leg 76 of the spring engages a wall 78 between walls 58 and 18 and the other leg 80 of the spring engages the detent 62 to bias the detent counterclockwise as viewed in FIGS. 3 and 4 so that the detent shoulder 68 engages either a shoulder 82 of the latch bolt 32 as shown in FIG. 4 to hold the latch position in full latched position or a shoulder 84 of the latch bolt to hold the latch bolt in an intermediate latched position, not shown.

The latch frame 12 includes a generally V or U-shaped recess 86 which opens through the wall 18 and receives a striker 88, FIGS. 3 and 4, which is mounted on the body pillar of the body. The throat of latch bolt 32 engages the leading leg of the striker 88 when the bolt is in either latched position to maintain the vehicle door on which the latch 10 is mounted in a closed and latched position. The details of the striker 88 are not shown herein and reference may be had to application Ser. No. 895,195 for such details.

A cover 90, FIG. 2, fits over walls 18 and 58 and is secured in place by a screw 92 which is received within a tapped abutment 94 of the latch frame. When the closure latch 10 is mounted to the latch pillar end wall of a vehicle door, a series of bolts, not shown, extend through such end wall and through cover 90 and are threaded into internal threads of the studs 24, 26 and 60 to mount the closure latch 10 to the vehicle door.

Referring now to FIGS. 1, 5, 6, 7 and 8 the actuating means controlling movement of the detent 62 to undetented position will now be described. A wall 96 of the latch frame 12, which provides the base wall of the recess 54, includes three integral posts 98, 100 and 102. The post 98 rotatably mounts a unitary larger diameter gear 104 and a smaller diameter pinion 106, FIG. 5. The gear 104 is driven by the output gear 108, FIG. 1, of a small electric motor 110 which is supported within a housing 112 of a back plate 114 which covers a portion of the open side 16 of the latch frame 12. Plate 114 is sonic welded at its edges to the periphery of latch frame 12.

Pinion 106 meshes with a larger diameter gear 116 which is unitary with a smaller diameter pinion 118, both being rotatably mounted on the post 100. Pinion 118 in turn meshes with a larger diameter gear 120 which is unitary with a smaller diameter pinion 122, both rotatably mounted on the post 102. All gears and pinions have helical teeth.

Figure 5:
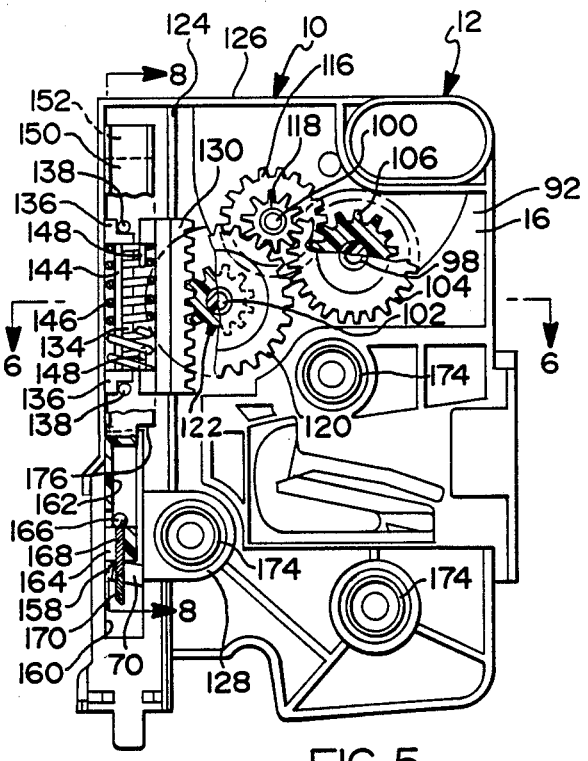
FIG. 5 is a view showing the actuating means when the latch bolt is in latched position.
Figure 6:
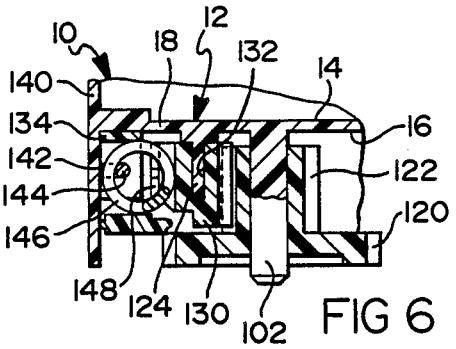
FIG. 6 is an enlarged view taken along line 6—6 of FIG. 5.
Figure 7:
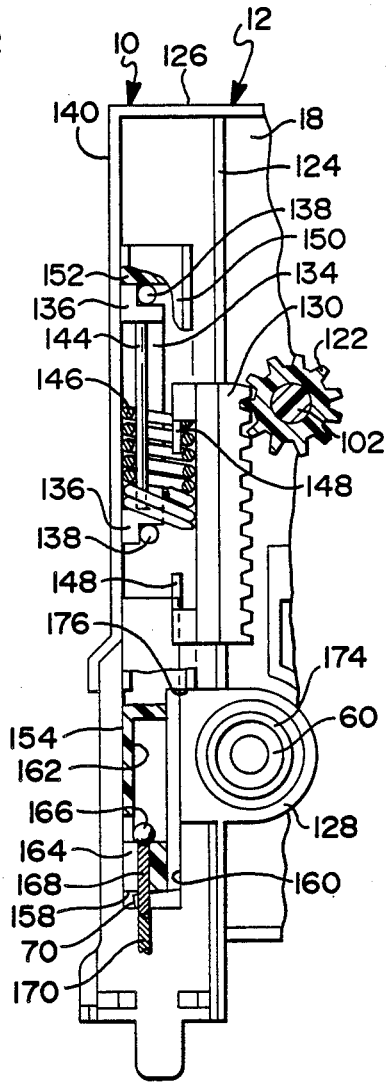
FIG. 7 is a view similar to FIG. 5 and showing the rack and actuator in their respective driving and operating positions.

The latch frame includes an integral rib 124 which is formed on wall 18 and extends from the upper peripheral wall 126 of the latch frame to an apertured boss 128 which receives the stud 60 on side 16. A rack 130, best shown in FIG. 1, includes a groove 132 which receives the rib 124 to slidably mount the rack on the latch frame 12 for vertical movement between a normal position as shown in FIG. 5 and a driving position as shown in FIG. 7, as will be further described. The rack teeth mesh with the pinion 122, FIGS. 5 and 6. The groove 132 is slightly larger than rib 124 to ensure free movement of the rack along the rib. The rib 124 controls the distance between the teeth of rack 130 and the center of post 102.

A U-shaped cassette or housing 134 includes tabs 136 on its upper and lower legs which force fit between integral tabs 138 of wall 18 and a peripheral side wall 140 of the latch frame 12 to thereby mount the housing 134 to the latch frame. The housing 134 includes closed grooves 142, FIGS. 1 and 6, in the juxtaposed faces of its upper and lower legs which receive the ends of a pin 144. The pin mounts a compression spring 146 which is compressed between the legs of housing 134. The pin and the spring 146 are mounted to the housing 134 before the tabs 136 of the housing are force fitted between tabs 138 and wall 140. As best shown in FIGS. 5, 6, and 7, the rack 130 includes oppositely extending triangular shaped or pointed integral tangs 148 which are received within the ends of the compressed spring 146. The spring 146 resiliently locates the rack 130 in its neutral position as shown in FIGS. 5 and 6. Inasmuch as the spring 146 is compressed between the upper and lower legs of the housing 134, the spring bows slightly between its compressed ends and engages the rack between the tangs 148 as shown in FIGS. 5 and 6. This applies a biasing force on rack 130 to the right as viewed in FIGS. 5 and 6 to hold the rack teeth against the teeth of the pinion 122 for tolerance take up purposes.

Figure 1:
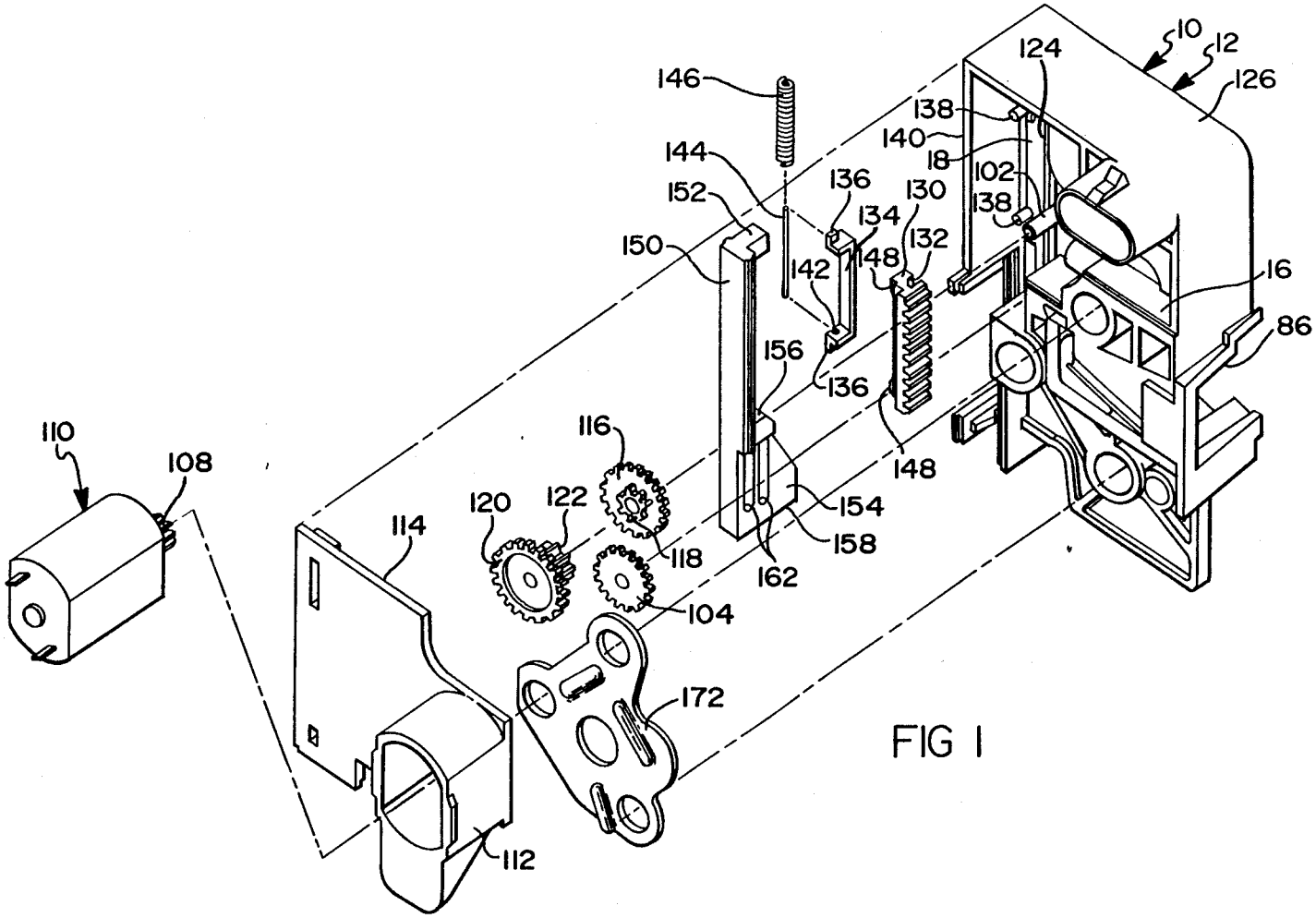
FIG. 1 is a blown apart perspective view of the closure latch showing the actuating means.
Figure 8:
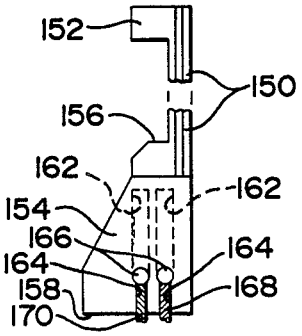
FIG. 8 is a view taken generally along line 8—8 of FIG. 5.

An actuator 150 includes upper and lower arms 152 and 154, FIGS. 1 and 8, which straddle the rack 130. The lower arm 154 includes an upper edge or shoulder 156 and a lower edge or shoulder 158. As best shown in FIGS. 3, 4, 5 and 7, the arm 154 projects through the latch frame 12 from the side 16 thereof to the side 14 thereof through a vertical slot 160 immediately adjacent the wall 140. The shoulder 158 of the arm 154 seats on the extension 70 of the detent 62 as shown in FIG. 4 while the shoulder 156 of arm 154 is located immediately adjacent the lower edge of the rck 130 as shown in FIG. 5. Spring 146 and extension 70 thus locate the rack and actuator in their respective neutral positions.

As best shown in FIGS. 1, 5, 7 and 8, the arm 154 of the actuator 150 includes a pair of closed slots 162 in one side thereof which open through the arm at their lower ends to keyhole slots 164 in the other side thereof. The keyhole slots receive the ball ends 166 of a pair of cables 168 and 170. These cables provide for manual movement of the actuator 150, as will be described. The cable 168 may be connected to the key cylinder of the vehicle door on which the latch 10 is mounted or to a remote manual operator in the vehicle trunk or elsewhere. The cable 170 is connected to the inside release operator of the vehicle door.

To complete the latch 10, a back plate 172, FIG. 1, is mounted over the ends 174, FIG. 2, of the studs 24, 26 and 60 and located underneath the back plate 114. The ends 174 of the studs are headed over the back plate 172 to secure it in place.

When the latch bolt 32 is in full latched position as shown in FIG. 4 and the detent shoulder 68 is in engagement with the bolt shoulder 82 to maintain the bolt in this position, the shoulder 158 of the actuator arm 154 seats on the detent extension 70 to locate the actuator in neutral position. The rack 130 is located in its neutral position by interengagement of the tangs 148 with the ends of the compressed spring 146. The lower edge of the rack is slightly spaced from the shoulder 156 of the arm 154 of the actuator 150. If the latch bolt were in intermediate latched position, the actuator and rack would be located in their same neutral positions.

If it is now desired to release the bolt 32 for movement to unlatched position as shown in FIG. 3 under the bias of the spring 42, the detent 62 must be moved clockwise from its FIG. 4 position to its FIG. 3 position against the bias of the spring 72. In order to accomplish this, the motor 110 is powered by the driver or passenger in the manner set forth in Ser. No. 164,903 to shift the rack 130 downwardly as viewed in FIG. 5 to its driving position through the gear train which consists of gear 104 being driven by the motor gear 108, the gear 116 being driven by pinion 106, gear 120 being driven by pinion 118, and pinion 122 driving the rack 130. As the rack 130 is moved downwardly to its driving position shown in FIG. 7, it compresses the spring 146 concurrently as it shifts the actuator 150 downwardly from its neutral position to its operating position, as shown in FIG. 7, by engagement of the lower leg of the rack with shoulder 156. When the actuator 150 is shifted by the rack downwardly to its operating position, it moves the detent 62 to its undetented position as shown in FIG. 3 by engagement of the shoulder 158 with extension 70. When the actuator reaches the operating position, a shoulder 176 of the actuator engages the boss 128, FIG. 7, to positively stop the actuator and stall the motor 110. As soon as the driver or passenger releases the power from the motor, such as by releasing a switch, the biasing force of the spring 146 shifts the rack 130 upwardly from its driving position to its neutral position as shown in FIG. 5. The motor 110 is back driven through the aforenoted gear train during this movement of the rack from the driving position to the neutral position. The shoulder 158 of actuator 150 remains seated on the extension 70 of the detent 62 during movement of the rack 130 from driving position to neutral position.

Thereafter when the bolt moves from the unlatched to the fully latched position as shown in FIG. 4, the movement of the detent from the undetented to the detented position shifts the actuator 150 upwardly so that the shoulder 156 of the arm 154 is again located immediately adjacent the lower edge of the rack 130.

Although this invention has been described with the actuator 150 being directly coupled to the detent 62 through the engagement of shoulder 158 with the extension 70 of the detent, the actuator 148 may be indirectly coupled to the detent to move the detent to undetented position through one or more intermediate operating levers which are commonly used in vehicle closure latches. The actuator 150 could also be directly coupled to a locking means of the closure latch, such as a locking lever, to move the locking means between locked and unlocked positions and thus control movement of the latch bolt to unlatched position by placing the closure latch in either locked or unlocked condition.

If the actuator 150 is directly coupled to a locking lever, the motor 110 must be bi-directional since rack 130 must move downwardly as previously described, to move the actuator to a first operating position and concurrently move the locking lever to one of its position. The rack must also move upwardly to concurrently move the actuator from the first operating position to a second operating position by engagement of the upper edge of the rack with the upper arm 152 of the actuator. Locking levers are conventionally located in either locked or unlocked position by the action of an overcenter spring. Thus, once the power is released from the motor 110, the actuator 150 would be held in either its first or its second operating position by the overcenter spring of the locking lever. Additionally, if the locking lever is coupled to a manual operator, such as a key cylinder or other outside operator or an inside release handle or knob, operation of such manual operator would move the actuator from one operating position to the other operating position concurrently with movement of the locking lever from one of its positions to the other of its positions. The actuator would not have a neutral position if directly coupled to a locking lever and the spacing of shoulder 156 and arm 152 relative to the upper and lower edges of the rack 130 would have to permit independent movement of the actuator by the locking lever while the rack remains stationary in its neutral position. Thus, although the detent 62 provides one type of latch operator which controls movement of the latch bolt to unlatched position, the actuating means of this invention may be used with other types of latch operators.

Should for any reason manual release of the bolt 32 be required, actuation of either the inside release operator, not shown, or the outside key cylinder, not shown, will shift either cable 168 or 170 downwardly as viewed in FIGS. 5 and 8 to in turn shift the actuator 150 downwardly to its operating position, as previously described, to release the detent in the same manner as described. Upon movement of the detent 62 to its detented position, as previously described, the actuator 150 will again be shifted upwardly to neutral position to locate the shoulder 156 thereof immediately adjacent the lower edge of the rack 130. Rack 130 remains stationary during manual release of latch bolt 32.

Thus this invention provides an improved actuating means controlling movement of a latch bolt of a closure latch between latched and unlatched positions.

The embodiments of the invention in which an exclusive property or privilege is claimed are defined as follow:

1. A closure latch comprising, in combination, a latch frame, a latch bolt mounted on one side of the latch frame for movement between latched and unlatched positions, a latch operator mounted on the one side of the latch frame and movable to a latch bolt release position to control movement of the latch bolt to unlatched position, an actuating means controlling the latch operator and including, an actuator mounted on the other side of the latch frame for movement between neutral and operating positions, means on the actuator extending to the one side of the latch frame for engagement with the latch operator to move the latch operator to release position concurrently with movement of the actuator to operating position, driven means, means mounting the driven means on the other side of the latch frame for movement between neutral and driving positions, resilient means locating and driven means in the neutral position and resisting movement thereof to the driving position, power operated driving means for moving the driven means from the neutral position to the driving position, and means on the driven means engageable with the actuator for moving the actuator to the operating position upon movement of the driven means to the driving position, the resilient means returning the driven means to the neutral position upon cessation of operation of the power operated driving means.

2. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for movement between neutral and operating positions, means on the actuator engageable with the latch operator to move the latch operator to release position, rack means, means mounting the rack means on the latch frame for linear movement between neutral and driving positions, resilient means locating the rack means in the neutral position and resisting movement thereof to the driving position, power operated gear means engageable with the rack means for moving the rack means from the neutral position to the driving position, and means on the rack means engageable with the actuator for moving the actuator to the latch bolt release position upon movement of the rack means to the driving position, the resilient means returning the rack means to the neutral position upon cessation of operation of the power operated means.

3. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for movement between neutral and operating positions, cooperating means on the actuator and latch operator for moving the latch operator to release position upon movement of the actuator to operating position, driven means, means mounting the driven means on the latch frame for movement between neutral and driving positions, resilient means locating the driven means in the neutral position and resisting movement thereof to the driving position, power operated driving means operatively connected to the driven means for moving the driven means from the neutral position to the driving position, and means operatively connecting the driven means to the actuator for moving the actuator to the operating position upon movement of the driven means to driving position, the resilient means returning the driven means to the neutral position upon cessation of operation of the power operated driving means, the actuator remaining in the operating position and the latch operator remaining in the release position upon return of the driven means to the neutral position.

4. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for movement between neutral and operating positions, means on the actuator engageable with the latch operator to locate the actuator in neutral position, the actuator moving the latch operator to release position upon movement of the actuator to operating position, driven means, means mounting the driven means on the latch frame for movement between neutral and driving positions, resilient means locating the driven means in the neutral position and resisting movement thereof to the driving position, power operated driving means for moving the driven means from the neutral position to the driving position, and means on the driven means engageable with the actuator upon movement of the driven means to the driving position for moving the actuator from neutral position to operating position, the resilient means returning the driven means to the neutral position upon cessation of operation of the power operated driving means, the actuator remaining in the operating position and the latch operator remaining in the release position upon return of the driven means to the neutral position.

5. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for linear movement in opposite directions relative thereto, means locating the actuator in a neutral position against movement in one direction to an operating position, the actuator moving the latch operator to release position upon movement of the actuator in the one direction to operating position, driven means, means mounting the driven means on the latch frame for linear movement in the one direction between neutral and driving positions, resilient means locating the driven means in the neutral position and resisting movement thereof to the driving position, power operated driving means engageable with the driven means for moving the driven means to the driving position, and means for moving the actuator to the operating position upon movement of the driven means to the driving position, the resilient means returning the driven means to the neutral position upon cessation of operation of the power operated driving means, the actuator remaining in the operating position and the latch operator remaining in the release position upon return of the driven means to the neutral position.

6. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for movement relative thereto between a first position and a second position, the actuator moving the latch operator to release position upon movement of the actuator to the second position, rack means, means mounting the rack means on the latch frame for movement relative thereto between first and second positions, resilient means locating the rack means in the first position and resisting movement thereof to the second position, power operated driving means for moving the rack means from the first position to the second position, means on the rack means engageable with the actuator for moving the actuator to the second position upon movement of the rack means to the second position, and means stalling the power operated means upon movement of the actuator to the second position, the resilient means returning the rack means to the first position upon cessation of operation of the power operated driving means.

7. A closure latch comprising, in combination, a latch frame, a latch bolt mounted on the latch frame for movement between latched and unlatched positions, a latch operator movable to a latch bolt release position to control movement of the latch bolt to unlatched position, and actuating means controlling the latch operator and including, an actuator mounted on the latch frame for movement relative thereto between first and second positions, means locating the actuator in the first position against movement to the second position, the actuator moving the latch operator to release position upon movement of the actuator to the second position, linear rack means, track means mounting the rack means on the latch frame for linear movement between first and second positions, linearly compressed spring means engaged at linearly spaced locations by the rack means to locate the rack means in the first position and resist movement thereof to the second position, gear means engageable with the rack means to move the rack means to the second position, the linearly compressed spring means bowing intermediate the linearly spaced locations and engaging the rack means to bias the rack means into engagement with the gear means, means on the rack means engageable with the actuator for moving the actuator to the second position upon movement of the rack means from the first position to the second position, the spring means being further linearly compressed upon movement of the rack means to the second position and returning the rack means to the first position upon cessation of operation of the gear means.

8. The combination recited in claim 6 wherein the stalling means is engageable by the actuator in the second position of the actuator for stopping movement of the rack means and stalling the power operated driving means.

9. The combination recited in claim 2 wherein the actuator is located in the neutral position by engagement with the latch operator.

10. The combination recited in claim 2 wherein the actuator is located in the neutral position by engagement with the latch operator and remains in the operating position in engagement with the latch operator when the rack means returns to the neutral position.

11. The combination recited in claim 2 including second driving means for moving the actuator to the operating position independently of movement of the rack means.

* * * * *